US006165702A

United States Patent [19]

Smith et al.

[11] Patent Number: 6,165,702

[45] Date of Patent: Dec. 26, 2000

[54] IMAGING ELEMENT CONTAINING POLYMER PARTICLES AND LUBRICANT

[75] Inventors: Dennis E. Smith, Rochester; Yongcai Wang; Charles C. Anderson, both of Penfield, all of N.Y.

[73] Assignee: Eastman Kodak Company, Rochester, N.Y.

[21] Appl. No.: 09/483,885

[22] Filed: Jan. 18, 2000

Related U.S. Application Data

[63] Continuation-in-part of application No. 08/879,060, Jun. 19, 1997, abandoned.

[51] Int. Cl.[7] ..... G03C 1/76

[52] U.S. Cl. ..... 430/537; 430/536; 430/627; 430/628; 430/961

[58] Field of Search ..... 430/527, 536, 430/537, 539, 627, 628, 961

[56] References Cited

U.S. PATENT DOCUMENTS

| | | | |
|---|---|---|---|
| 2,454,043 | 11/1948 | Dimsdale et al. . | |
| 2,588,765 | 3/1952 | Robijns . | |
| 2,732,305 | 1/1956 | Richman et al. . | |
| 2,976,148 | 3/1961 | Walford . | |
| 3,042,522 | 7/1962 | Ben-Ezra . | |
| 3,080,317 | 3/1963 | Tallet et al. . | |
| 3,121,060 | 2/1964 | Duane . | |
| 3,206,311 | 9/1965 | Campbell et al. . | |
| 3,489,567 | 1/1970 | McGraw . | |
| 3,502,473 | 3/1970 | Snellman et al. . | |
| 3,933,516 | 1/1976 | Mackey | 106/131 |
| 4,004,927 | 1/1977 | Tamamoto et al. | 427/96 |
| 4,047,958 | 9/1977 | Yoneyama et al. | 430/531 |
| 4,427,964 | 1/1984 | Ruegaegger | 337/231 |
| 4,766,059 | 8/1988 | Vandenabeele et al. | 430/531 |
| 5,541,048 | 7/1996 | Whitesides et al. . | |
| 5,554,494 | 9/1996 | Shiratsuchi et al. . | |
| 5,563,226 | 10/1996 | Muehlbauer et al. | 526/173 |
| 5,695,919 | 12/1997 | Wang et al. | 430/536 |
| 5,709,986 | 1/1998 | Smith et al. | 430/536 |
| 5,756,273 | 5/1998 | Wang et al. | 430/537 |

FOREIGN PATENT DOCUMENTS

| | | |
|---|---|---|
| 241600 | 10/1987 | European Pat. Off. . |
| 749041 | 12/1996 | European Pat. Off. . |
| 1284294 | 11/1968 | Germany . |
| 1284295 | 11/1968 | Germany . |
| 955061 | 4/1964 | United Kingdom . |
| 1143118 | 2/1969 | United Kingdom . |
| 1198387 | 7/1970 | United Kingdom . |
| 1263722 | 2/1972 | United Kingdom . |
| 1320565 | 6/1973 | United Kingdom . |
| 1320757 | 6/1973 | United Kingdom . |
| 1430997 | 4/1976 | United Kingdom . |
| 1466304 | 3/1977 | United Kingdom . |

*Primary Examiner*—Richard L. Schilling
*Attorney, Agent, or Firm*—Doreen M. Wells

[57] ABSTRACT

The present invention is an imaging element which includes a support, at least one image forming layer, and a surface protective layer. The surface protective layer includes polymer particles having a mean particle size of less than 500 nm including a polymer or copolymer of an ethylenically unsaturated monomer, a water insoluble lubricant and a water soluble polymeric stabilizer coated on an outer surface of the polymer particle, and a binder. The polymeric stabilizer has affinity for both the organic solvent and the surface of the polymer particle.

10 Claims, No Drawings

IMAGING ELEMENT CONTAINING POLYMER PARTICLES AND LUBRICANT

CROSS REFERENCE TO RELATED APPLICATIONS

This is a continuation-in-part of application Ser. No. 08/879,060, filed Jun. 19, 1997, now abandoned, titled "Imaging Element Containing Polymer Particles And Lubricant".

FIELD OF THE INVENTION

This invention relates to an imaging element with improved physical properties of its surface layer, and in particular to an imaging element comprising a support, at least one image-forming layer, and a surface protective layer. More specifically, this invention relates to such imaging elements having a surface protective layer exhibiting superior surface lubricity and excellent manufacturing characteristics.

BACKGROUND OF THE INVENTION

During the handling of a photographic material, such as coating, drying, finishing, winding, rewinding, printing, projecting, and so on, the material surfaces are often harmed by contact friction with other apparatus and between its front and back faces. For example, scratches or abrasions can be brought about on the emulsion and backside of a photographic material. These scratches or abrasion marks are visible during printing or projecting processes. This causes serious problems in the practical use of the films. Moreover, when the contact friction is high, the photographic materials do not transport smoothly during the manufacturing process or in various exposure, processing, and projection machines. These transport problems may result in product waste. In recent years, the conditions under which the photographic materials are manufactured or utilized have become more severe, because their applications have been extended (for example, in an atmosphere of high humidity and high temperature) or because the methods for their preparation have been advanced (for example, high speed curtain coatings, high speed finishing and cutting, and fast processing). Under these conditions, the photographic materials are more easily scratched.

To lower the contact friction and improve the resistance to damage to surfaces, a lubricant or slipping agent is often used. Examples of the lubricants used for those purposes include silicone fluids as described in U.S. Pat. No. 3,489,567, and wax esters of high fatty acids or high fatty alcohols in U.S. Pat. No. 3,121,060. Problems are encountered in the use of these lubricants. For example, waxes such as Carnauba wax have been used to form the backing lubricant layer. However, they need to be coated from solvents such as propylene dichloride, which is on the EPA P/U highly hazardous list. Furthermore, waxes in most cases have to be applied as a separate layer, which requires an additional coating station and therefore increases product cost.

U.S. Pat. No. 4,766,059 describes a method of making solid spherical beads having a mean size ranging form 0.5 to about 20 $\mu$m. The polymer beads contain a polymeric resinous material and a water insoluble wax. However, the process of making such solid beads involves the use of water miscible or immiscible low boiling solvent to dissolve both polymeric materials and wax, and subsequently removal of the solvent or solvent mixture by evaporation. This requires large processing equipment and lengthy processing time, which increases the expenses of making these beads. Use of solid spherical beads of such large sizes in a surface protective layer also significantly increases surface haze, lowers surface gloss, and therefore degrades image quality.

Therefore, a foremost objective of the present invention is to provide an imaging element, in particular a photographic element, with a new surface protective layer composition which can be applied from a low hazard organic solvent or solvent mixture. The coating compositions used to form such a surface lubricant layer are stable with respect to manufacturing processes. The surface protective layer prepared has excellent surface appearance and lubricity.

SUMMARY OF THE INVENTION

The present invention is an imaging element which includes a support, at least one image forming layer, and a surface protective layer. The surface protective layer includes polymer particles having a mean particle size of less than 500 nm including a polymer or copolymer of an ethylenically unsaturated monomer, a water insoluble lubricant and a water soluble polymeric stabilizer coated on an outer surface of the polymer particle, and a binder. The polymeric stabilizer has affinity for both the organic solvent and the polymer particle surface.

DETAILED DESCRIPTION OF THE INVENTION

In accordance with the present invention, an imaging element includes a support, at least one image-forming layer, and a surface protective layer formed from a coating composition comprising polymer particles and a binder in an organic solvent, the polymer particles having a mean particle size of less than 500 nm, preferably less than 400 nm and comprising a polymeric resinous material, a water insoluble lubricant, and polymeric stabilizer coated on the particle surface, the said polymeric stabilizer being water soluble and having affinity for both the organic solvent and the polymer particle surface, the said polymeric resinous material being composed of a polymer or a copolymer made of vinyl monomers or their mixtures. The amount of water insoluble lubricant incorporated into the polymer particles is from about 1 to 80% by weight, preferably from 5 to 50% by weight, and most preferably from 5 to 40% by weight.

The coating compositions of the present inventions are particularly advantageous due to their unique ability to incorporate a lubricant, which may be insoluble in the coating solvent medium, into the coated surface protective layer. This eliminates the need to utilize undesirable solvents, such as chlorinated solvents, which are otherwise needed to dissolve the lubricants. During the drying process the lubricant can diffuse out of the polymer particles to the coating surface, thus eliminating the need to apply the lubricant as a separate layer and greatly reducing manufacturing complexity and cost. In this regard, it is preferable that the polymer particles are crosslinked to prevent the polymeric resinous materials from dissolving in the coating solvent medium since that may cause insoluble lubricant to precipitate or to form a separate phase.

The lubricant used for the purpose of the present invention can be any of the known classes of lubricants as described, for example, in references such as "The Chemistry and Technology of Waxes", A. H. Wrath, $2^{nd}$ Ed., Reinhold Publishing Corporation, New York, N.Y., 1956, and "Plastic Additives and Modifiers Handbook", Chapter 54–59, J. Edenbaum (Ed.), Van Nostrand Reinhold, New York, N.Y., 1992. These lubricants include: (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, higher fatty acid esters, higher fatty acid amides, polyhydric alcohol esters of higher fatty acids, etc. disclosed in U.S. Pat. Nos. 2,454,043, 2,732,305, 2,976,148, 3,206,311, 3,933,516, 2,588,765, 3,121,060, 3,502,473, 3,042,222, and 4,427,964, in British Patent Nos. 1,263,722, 1,198,387, 1,430,997, 1,466,304, 1,320,757, 1,320,565, and 1,320,756, and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, and the like. Lubricants useful in the present invention are described in further detail in Research Disclosure No. 308119, published Dec. 1989, page 1006. Water insoluble waxes and liquid parrafins are preferred lubricants for the practice of this present invention.

The polymeric resinous materials contained in the polymer particles of the present invention are mostly hydrophobic and are composed of a polymer or a copolymer made of the following ethylenically unsaturated monomers or their mixtures: alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitrile and amides of the same acids such as acrylonitrile, methacrylonitrile, and butyl acrylamide, vinyl acetate, vinyl propionate, vinylidene chloride, vinyl chloride, and vinyl aromatic compounds such as styrene, t-butyl styrene, ethyl vinyl benzene, vinyl toluene, dialkyl maleates, dialkyl itaconates, dialkyl malonates, isoprene, and butadiene. Crosslinking and grafting monomers which may be used together with the foregoing monomers to crosslink the polymer particles are polyfunctional with respect to the polymerization reaction, and may include, for example, esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate, and polyfunctional aromatic compounds such as divinyl benzene.

The water insoluble lubricants are preferably soluble or at least partially miscible with the polymeric resinous materials to insure good stability. The structures of the polymeric resinous materials can always be designed to meet such a requirement. Defining solubility or miscibility of lubricant materials in a polymeric resinous material can be achieved by using the concept of "solubility parameter" (see, for example, Ramsbotham, J, in Progress in Organic Coatings, Vol. 8, pages 113–141, 1980, and Van Krevelen, D. W. in Properties of Polymers, 3$^{rd}$ Ed. Pages 189–224, Elsevier Science Publishers, B. V.).

The polymeric stabilizers used for the present invention are soluble in water. By "water soluble" it is meant that the polymeric stabilizers are completely soluble in water. At low concentrations, their solution in water is clear and at high concentrations, their solution in water is viscous but clear. U.S. Pat. No. 5,695,919 describes a lubricant impregnated core shell particle having a shell portion that has affinity for both the core portion and an organic solvent medium. Nowhere in '919 is it taught to use a water soluble polymeric stabilizer. The shell polymers in Example 1 and 2 in '919 comprise 20% by weight methacrylic acid monomer. However, the shell polymers are not water soluble and therefore are not suitable for the present invention.

The affinity of the polymeric stabilizers for both organic solvent and polymer particle insures that the polymer particles incorporated with water-insoluble lubricants can be easily dispersed in an organic solvent, and the resultant dispersion has good shelf-life and is stable with respect to manufacturing processes such as solution delivery, filtration, and coating. It is therefore preferable that the polymeric stabilizer is at least partially soluble in the organic solvent and most preferably completely soluble in the organic solvent. Polymer structures can always be optimized to meet these requirements by, for example, using functional monomers during the polymerization process or introducing functional groups into an existing polymer by post polymerization modification. Examples of such polymeric stabilizers include polymers comprising the following monomer residues: (meth)acrylic acid, vinyl pyrrolidone, (meth) acrylamide, N.N-dimethyl acrylamide, vinyl methyl ether, maleic acid, maleic anhydride, itaconic acid, ethylene oxide, hydroxyl alkyl (meth)acrylates, and the like. Other comonomers which can be used together with the above monomers to form the polymeric stabilizers useful for the present invention include, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, and the nitrile and amides of the same acids such as acrylonitrile, methacrylonitrile, and butyl acrylamide, vinyl acetate, vinyl propionate, vinylidene chloride, vinyl chloride, and vinyl aromatic compounds such as styrene, t-butyl styrene, ethyl vinyl benzene, vinyl toluene, dialkyl maleates, dialkyl itaconates, dialkyl malonates, isoprene, and butadiene.

In one of the preferred embodiments, the polymer particles of the present invention are prepared by the process of mechanically forming oil-in-water droplets having a mean size of less than 500 nm and comprising an ethylenically unsaturated monomer, a compound which has a higher $\log P_{(calc)}$ value than the monomer by at least one unit, and a water-insoluble lubricant; and polymerizing the droplet to form the polymer particles by using a free radical initiator. Mechanically forming water-in-oil droplets is done in the presence of a dispersion stabilizer or granulating agent and by using a mechanical shearing device such as an agitator, a high pressure homogenizer, colloid mill, an ultrasonic horn or the like. The polymeric stabilizers can be added before or after droplet formation but before completion of the polymerization reaction. It is preferred to add the polymeric stabilizer after the droplet formation as per U.S. Pat. No. 5,563,226. $\mathrm{Log}P_{(calc)}$ is the logarithm of the octanol-water partition coefficient calculated using Medchem version 3.54, a software package available from Medicinal Chemistry Project, Pomona College, Clairmont, Calif. The software package is well known and accepted in the chemical and pharmaceutical industries. $\mathrm{Log}P_{(calc)}$ is a parameter which is highly correlated with measured water solubility for compounds spanning a wide range of hydrophobicity. The non-reactive hydrophobic compounds used in the present invention are either liquid or oil soluble salts. As indicated above, the non-reactive compound is more hydrophobic than that of the monomer or monomers and has a higher $\log P_{(calc)}$ than the monomer by at least 1 unit and more preferably by 3 units. Suitable non-reactive hydrophobic compounds are those selected from the following classes of compounds, among others:

I. Saturated and unsaturated hydrocarbons and halogenated hydrocarbons, including alkanes, alkenes, alkyl and alkenyl halides, alkyl and alkenyl aromatic compounds, and halogenated alkyl and alkenyl aromatic compounds, especially those having a $\text{Log}P_{(calc)}$ greater than about 3.

II. Esters of saturated, unsaturated, or aromatic carboxylic acids containing a total of about 10 or more carbon atoms, especially those having a $\text{Log}P_{(calc)}$ greater than about 3.

III. Amides of carboxylic acids having a total of 10 or more carbon atoms, especially those having a $\text{Log}P_{(calc)}$ greater than about 3.

IV. Esters and amides of phosphorus- and sulfur-containing acids having a $\text{Log}P_{(calc)}$ greater than about 3, and other compounds of similar hydrophobicity.

Compounds of Class I include: straight or branched chain alkanes such as, for example, hexane, octane, decane, dodecane, tetradecane, hexadecane, octadecane, 2,2,6,6,9,9-hexamethyldodecane, eicosane, or triacontane; alkenes such as, for example, heptene, octene, or octadecene; substituted aromatic compounds such as, for example, octylbenzene, nonylbenzene, dodecylbenzene, or 1,1,3,3-tetramethylbutylbenzene; haloalkanes such as, for example, heptyl chloride, octyl chloride, 1,1,1-trichlorohexane, hexyl bromide, 1,11-dibromoundecane, and halogenated alkyl aromatic compounds such as, for example, p-chlorohexylbenzene and the like.

Compounds of Class II include: methyl laurate, butyl laurate, methyl oleate, butyl oleate, methyl stearate, isopropyl palmitate, isopropyl stearate, tributyl citrate, acetyl tributyl citrate, phenethyl benzoate, dibutyl phthalate, dioctyl phthalate, dioctyl terephthalate, bis(2-ethylhexyl) phthalate, butyl benzyl phthalate, diphenyl phthalate, dibutyl sebacate, didecyl succinate, and bis(2-ethylhexyl) azelate and the like.

Compounds of Class III include: lauramide, N-methyllauramide, N,N-dimethyllauramide, N,N-dibutyllauramide, N-decyl-N-methylacetamide, and N-oleylphthalimide and the like.

Compounds of Class IV include, for example, sulfates, sulfonates, sulfonamides, sulfoxides, phosphates, phosphonates, phosphinates, phosphites, or phosphine oxides. Particular examples include diesters of sulfuric acid, such as, for example, dihexylsulfate, didecylsulfate, and didodecylsulfate; esters of various alkyl sulfonic acids including, for example, methyl decanesulfonate, octyl dodecanesulfonate, and octyl p-toluenesulfonate; sulfoxides, including, for example, bis(2-ethylhexyl) sulfoxide; and sulfonamides, including, for example, N-(2-ethylhexyl)-p-toluenesulfonamide, N-hexadecyl-p-toluenesulfonamide, and N-methyl-N-dodecyl-p-toluenesulfonamide. Phosphorus-containing compounds include, for example, triesters of phosphoric acid such as, for example, triphenyl phosphate, tritolylphosphate, trihexylphosphate, and tris(2-ethylhexyl)phosphate; various phosphonic acid esters, such as, for example, dihexyl hexylphosphonate, and dihexyl phenylphosphonate; phosphite esters such as tritolylphosphite, and phosphine oxides such as trioctylphosphine oxide.

Representative compounds are given below, along with their $\text{Log}P_{(calc)}$ value, calculated using the above-mentioned MedChem software package (version 3.54).

| | $\text{Log}P_{calc}$ |
|---|---|
| Nonreactive Compound | |
| hexane | 3.87 |
| octane | 4.93 |
| decane | 5.98 |
| dodecane | 7.04 |
| hexadecane | 9.16 |
| dimethylphthalate | 1.36 |
| dibutylphthalate | 4.69 |
| bis(2-ethylhexyl)phthalate | 8.66 |
| dioctylphthalate | 8.92 |
| tritolylphosphate | 6.58 |
| tris(2-ethylhexyl)phosphate | 9.49 |
| dodecylbenzene | 8.61 |
| bis (2-ethylhexyl) azelate | 9.20 |
| trioctylphosphine oxide | 9.74 |
| dinonyl phthalate | 9.98 |
| didecyl phthalate | 11.04 |
| didodecyl phthalate | 13.15 |
| 3-(4-hydroxy-3, 5 di-t-butylphenyl)-propionic acid, octadecyl ester | 14.07 |
| trioctyl amine | 10.76 |
| Monomer | |
| acrylic acid | 0.16 |
| isopropyl acrylamide | 0.20 |
| β-(hydroxyethyl) methacrylate | 0.25 |
| vinyl acetate | 0.59 |
| methyl acrylate | 0.75 |
| methyl methacrylate | 1.06 |
| ethyl acrylate | 1.28 |
| ethyl methacrylate | 1.59 |
| butyl acrylate | 2.33 |
| butyl methacrylate | 2.64 |
| styrene | 2.89 |
| divinyl benzene | 3.59 |
| mixture of vinyl toluenes | 3.37 |
| 2-ethylhexyl acrylate | 4.32 |
| 2-ethylhexyl methacrylate | 4.62 |
| t-butylstyrene | 4.70 |
| lauryl methacrylate | 6.88 |
| stearyl methacrylate | 10.05 |

The hydrophobic compound is employed in an amount of at least about 0.01, preferably at least about 0.05 and most preferably at least about 0.5 percent by weight based on the weight of the monomer. Hexadecane is the preferred non-reactive compound.

The hydrophobe compound can also be the polymerization initiator. Especially effective are peroxides with long alkyl chains such as lauroyl peroxide which has a logP(calc) of 10.61. Additionally, the hydrophobe can be a chain transfer agent such as N-dodecanethiol which has a logP (calc) of 6.47. or it can be a polymerizable monomer such as lauryl methacrylate or stearyl methacrylate.

A wide variety of materials can be used as binders in the coating compositions of the present invention to prepare the surface protective layer. Preferred binders are polymeric and include, for example, polyesters, polyamides, polyurethanes, cellulose derivatives, polyacrylates, polycarbonates, polyvinyl acetate, polyvinyl butyral, polyvinyl acetal, polystyrene, styrene-butadiene copolymers, epoxy resins, melamine resins, phenolic resins, vinylidene fluoride-containing polymers, and the like. The actual amount of binder and polymer particle will vary depending on the types of applications. It is preferred that the binder is coated at a weight ratio to the polymer particle from about 1:100 to 100:1, and more preferably from 20:80 to 95:5. Good surface lubricity can be obtained by coating the polymer particles of the present invention at coverage of greater than 5 mg/m$^2$. In principle, the upper value of the polymer particle coverage is limited actually by physical appearances of the surface rather than by the friction values of the layer. For example, if the coverage is too high, a hazy looking surface will appear, which therefore can have an effect on the sensitometric properties of the imaging element. The lower limiting value is set by the requirement on the surface friction value of the lubricant layer, which is determined by both manufacturing processes and applications of the imaging element.

As the organic solvent, any of the members customarily used in coating compositions may be satisfactorily used. However, the preferred solvents for the practice of the present invention may include alcohol, esters, ketones, aromatic hydrocarbons, chlorinated solvents, glycols, and their mixtures.

The polymeric binders useful for the present invention may include reactive functional groups capable of forming covalent bonds by intermolecular crosslinking or by reaction with a crosslinking agent. Suitable reactive functional groups include: hydroxyl, carboxyl, carbodiimide, epoxide, aziridine, vinyl sulfone, sulfinic acid, active methylene, amino, amide, allyl, and the like. Suitable crosslinking agents that may effectively be used in the coating compositions of the invention including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The surface protective layer can contain additives such as magnetic recording particles, abrasive particles, conductive polymers, conductive metal oxide particles, coating aids, charge control surfactants, matting agents, crosslinkers, and a secondary lubricant. There are no particular limits on the secondary lubricants that may be used. They may include, for example, polyether or polyester modified polysiloxane polymers, stearamide, oleamides, stearic acid, lauric acid, ethylene glycol distearate, ethylene glycol monostearate, and the like.

The coating composition of the present invention may be applied as solvent coating formulations containing up to 20% total solids by coating methods well known in the art. For example, hopper coating, gravure coating, skim pan/air knife coating, spray coating, and other methods may be used with very satisfactory results. The coatings are dried at temperatures up to 150° C. to give dry coating weight of 20 mg /m$^2$ to 10 g/m$^2$.

A preferred imaging element according to the present invention comprises one or more imaging layers on one side of the support and the said surface protective layer present on the other side of the support as an outermost backing layer, or an outermost layer coated on the top of an abrasion resistance backing layer, or an outermost layer coated on the top of an antistatic layer, or an outermost layer coated on an magnetic recording layer. The surface protective layer can contain additives such as magnetic recording particles, abrasive particles, conductive polymers, conductive metal oxide particles, coating aids, charge control surfactants, matting agents, and a secondary lubricant. There are no particular limits on the secondary lubricants that may be used. They may include, for example, polyether or polyester modified polysiloxane polymers, stearamide, oleamides, stearic acid, lauric acid, ethylene glycol distearate, ethylene glycol monostearate, and the like.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like.

The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the product to the consumer does not normally occur.

Single use camera and their methods of manufacture and use are described in U.S. Pat. Nos. 4,801,957; 4,901,097; 4,866,459; 4,849,325; 4,751,536; 4,827,298; European Patent Applications 460,400; 533 785; 537,225; all of which are incorporated herein by reference.

The photographic processing steps to which the raw film may be subject may include, but are not limited to the following:

1.) color developing→bleach-fixing→washing/stabilizing;

2.) color developing→bleaching fixing washing/stabilizing;

3.) color developing→bleaching bleach-fixing→washing/stabilizing;

4.) color developing→stopping→washing→bleaching→washing→fixing→washing/stabilizing;

5.) color developing→bleach-fixing→fixing→washing/stabilizing;

6.) color developing→bleaching→bleach-fixing→fixing→washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/109932; U.S. Pat. No. 5,294,956; EP 559,027; U.S. Pat No. 5,179,404; EP 559,025; U.S. Pat. No. 5,270,762; EP 559,026; U.S. Pat. No. 5,313,243; U.S. Pat. No. 5,339,131.

The present invention is also directed to photographic systems where the processed element may be re-introduced into the cassette. These system allows for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette.

The following examples are used to illustrate the present invention. However, it should be understood that the invention is not limited to these illustrative examples.

EXAMPLES

Examples 1–4: Synthesis of Polymer Particles Used in the Coating Solution Stability Study and Example Coatings Example 1: Comparative Particle-1:

To a beaker are added the following ingredients: 255 g methyl methacrylate, 127.5 g stearyl methacrylate, 127.5 g ethylene glycol dimethacrylate, 90 g light mineral oil (Fisher Scientific), 5 g hexadecane, 16.8 g Aerosol TO-100 (dioctyl ester of sodium sulfosuccinic acid), and 9 g 2,2'-azobis(2,4-dimethylvaleronitrile) sold by DuPont under the trade name Vazo 52. The ingredients are stirred until all the solids are dissolved. This solution is added to 2520 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco homogenizer operated at 5000 psi to form the final droplet size. 1000 g of the droplet dispersion is placed in a bottle. The bottle is sealed and reacted in a tumble bath at 52 degrees C. for 16 hours. The particle prepared by this process is stable and filters well, and has a mean size of 135 nm.

Example 2: Invention P-2 that uses poly(vinyl pyrrolidone) as a stabilizer

To a beaker are added the following ingredients: 255 g methyl methacrylate, 127.5 g stearyl methacrylate, 127.5 g ethylene glycol dimethacrylate, 90 g light mineral oil (Fisher Scientific), 5 g hexadecane, 16.8 g Aerosol TO-100 (dioctyl ester of sodium sulfosuccinic acid), and 9 g 2,2'-azobis(2,4-dimethylvaleronitrile) sold by DuPont under the trade name Vazo 52. The ingredients are stirred until all the solids are dissolved. This solution is added to 2520 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco homogenizer operated at 5000 psi to form the final droplet size. 500 g of the droplet dispersion is placed in a bottle and mixed with 250 g of a 10% poly(vinyl pyrrolidone) (molecular weight is about 40,000) solution. The bottle is sealed and reacted in a tumble bath at 52 degrees C. for 16 hours. The particle prepared by this process is stable and filters well, and has a mean size of 161 run.

Example 3: Comparative P-3

To a beaker are added the following ingredients: 255 g methyl methacrylate, 204 g stearyl methacrylate, 51 g ethylene glycol dimethacrylate, 90 g light mineral oil (Fisher Scientific), 5 g hexadecane, 16.8 g Aerosol TO-100 (dioctyl ester of sodium sulfosuccinic acid), and 9 g 2,2'-azobis(2, 4-dimethylvaleronitrile) sold by DuPont under the trade name Vazo 52. The ingredients are stirred until all the solids are dissolved. This solution is added to 2520 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco homogenizer operated at 5000 psi to form the final droplet size. 1000 g of the droplet dispersion is placed in a bottle. The bottle is sealed and reacted in a tumble bath at 52 degrees C. for 16 hours. The particle prepared by this process is stable and filters well, and has a mean size of 147 nm.

Example 4: Invention P-4 that uses poly(vinyl pyrrolidone) as a stabilizer

To a beaker are added the following ingredients: 255 g methyl methacrylate, 204 g stearyl methacrylate, 51 g ethylene glycol dimethacrylate, 90 g light mineral oil (Fisher Scientific), 5 g hexadecane, 16.8 g Aerosol TO-100 (dioctyl ester of sodium sulfosuccinic acid), and 9 g 2,2'-azobis(2, 4-dimethylvaleronitrile) sold by DuPont under the trade name Vazo 52. The ingredients are stirred until all the solids are dissolved. This solution is added to 2520 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco homogenizer operated at 5000 psi to form the final droplet size. 500 g of the droplet dispersion is placed in a bottle and mixed with 250 g of a 10% poly(vinyl pyrrolidone) (molecular weight is about 40,000) solution. The bottle is sealed and reacted in a tumble bath at 52 degrees C. for 16 hours. The particle prepared by this process is stable and filters well, and has a mean size of 175 nm.

Example 5: Coating Solution Stability

Stability of the polymer particles prepared above is tested by the following method: 1 g of each polymer particle prepared above is dispersed in about 20 g of a 60/40 acetone/methanol solvent mixture. Comparative polymer particles P-1 and P-3 settle down or precipitated out almost immediately. The invention polymer particles P-2 and P-4 which are stabilized with poly(vinyl pyrrolidone), on the other hand, are very stable, and no visible settle-down or precipitation is observed after 2 weeks storage at room temperature.

Example 6–14: Coating Examples

The following example demonstrates that the polymer particles of the invention may be coated in combination with polymeric binders such as the solvent-dispersible polymer described in U.S. Pat. No. 5,597,680 or cellulose acetate 320S which is manufactured by Eastman Chemical. The solvent dispersible polymer comprises a crosslinked poly (methyl methacrylate) core and a poly(methyl methacrylate-co-methacrylic acid) shell. The coating compositions are applied as backing layers onto a poly(ethylene terephthalate) film support that has been subbed with a terpolymer latex (vinylidene chloride, methyl acrylate, and itaconic acid) layer. The backing layer is applied at a total dry coating weight of 800 mg/m$^{2.}$ Comparative examples have a backing layer that comprises only the solvent-dispersible polymer particle or cellulose acetate 320S. The coatings are tested for coefficient of friction using the methods set forth in ANSI IT 9.4-1992. The results are tabulated in Table 1. The backing layers prepared from the coating compositions in accordance with the present invention have excellent surface appearance and surface lubricity.

TABLE 1

| Example | Polymer Binder | Polymer Particle: And Concentration* | Coefficient of Friction |
|---|---|---|---|
| Example 6 (Comparison) | Solvent Dispersible Polymer | None | 0.44 |
| Example 7 (Invention) | Solvent Dispersible Polymer | P-2 9.1 wt % | 0.34 |
| Example 8 (Invention) | Solvent Dispersible Polymer | P-4 9.1 wt % | 0.33 |
| Example 9 (Invention) | Solvent Dispersible Polymer | P-4 16.7 wt % | 0.25 |
| Example 10 (Comparison) | Cellulose Acetate 320S | None | 0.50 |
| Example 11 (Invention) | Cellulose Acetate 320S | P-2 9.1 wt % | 0.37 |
| Example 12 (Invention) | Cellulose Acetate 320S | P-2 16.7 wt % | 0.32 |
| Example 13 (Invention) | Cellulose Acetate 320S | P-4 9.1 wt % | 0.31 |
| Example 14 (Invention) | Cellulose Acetate 320S | P-4 16.7 wt % | 0.26 |

*Based on the total dry coverage

The invention has been described in detail with particular reference to certain preferred embodiments thereof, but it will be understood that variations and modifications can be effected within the spirit and scope of the invention.

What is claimed is:

1. An imaging element comprising;

a support;

at least one image forming layer;

a surface protective layer comprising polymer particles having a mean particle size of less than 500 nm comprising a polymer or copolymer of an ethylenically unsaturated monomer, a water insoluble lubricant and a water soluble polymeric stabilizer coated on an outer surface of said polymer particle, and a binder, wherein the polymeric stabilizer has affinity for both an organic solvent and a surface of the polymer particles.

2. The imaging element of claim 1, wherein the water insoluble lubricant is selected from the group consisting of silicone based materials, fatty acids, fatty acid derivatives, alcohols, alcohol derivatives, fatty acid esters, fatty acid amides, polyhydric alcohol esters of fatty acids, paraffin, carnauba wax, natural waxes, synthetic waxes, petroleum waxes, mineral waxes, perfluoro-containing materials, fluoro-containing materials, and fluorochloro-containing materials.

3. The imaging element of claim 1 wherein the ethylenically unsaturated monomer is selected from the group consisting of alkyl esters of acrylic acid, alkyl esters of methacrylic acid, hydroxyalkyl esters of acrylic acid, hydroxyalkyl esters of methacrylic acid, nitriles of acrylic acid, nitriles of methacrylic acid, amides of acrylic acid, amides of methacrylic acid, vinyl acetate, vinyl propionate, vinylidene chloride, vinyl chloride, vinyl aromatic compounds, dialkyl maleates, diallyl itaconates, dialkyl malonates, isoprene, and butadiene.

4. The imaging element of claim 1 wherein the polymer particles are crosslinked with a crosslinking agent selected from the group consisting of esters of unsaturated monohydric alcohols with unsaturated monocarboxylic acids, esters of saturated glycols with unsaturated monocarboxylic acids, esters of saturated diols with unsaturated monocarboxylic acids, and polyfunctional aromatic compounds.

5. The imaging element of claim 1 wherein the water soluble polymeric stabilizer comprises a polymer having a monomer residue selected from the group consisting of (meth)acrylic acid, vinyl pyrrolidone, (meth)acrylamide, N,N-dimethyl acrylamide, vinyl methyl ether, maleic acid, maleic anhydride, itaconic acid, ethylene oxide, and hydroxyl alkyl (meth)acrylates.

6. The imaging element of claim 1 wherein the binder is selected from the group consisting of polyesters, polyamides, polyurethanes, cellulose derivatives, polyacrylates, polycarbonates, polyvinyl acetate, polyvinyl butyral, polyvinyl acetal, polystyrene, styrene-butadiene copolymers, epoxy resins, melamine resins, phenolic resins, and vinylidene fluoride-containing polymers.

7. The imaging element of claim 1 wherein the binder is coated at a weight ratio to the polymer particle from about 1:100 to 100:1.

8. The imaging element of claim 1 wherein the polymer particles are present at a coverage of greater than 5 $mg/m^2$.

9. The imaging element of claim 1 wherein the imaging element comprises a photographic element.

10. The imaging element of claim 1 wherein the binder is coated at a weight ratio to the polymer particle from about 20:80 to 95:5.

* * * * *